United States Patent [19]

Haas et al.

[11] 4,454,641

[45] Jun. 19, 1984

[54] METHOD OF ASSEMBLING A HEATING EXCHANGER

[75] Inventors: Rudy E. Haas, East Syracuse; Michael E. Smorol, Syracuse; Curtis L. Tobin, Chittenango, all of N.Y.; James J. Walker, Jr., Merrimack, N.H.

[73] Assignee: Carrier Corporation, Syracuse, N.Y.

[21] Appl. No.: 466,181

[22] Filed: Feb. 14, 1983

Related U.S. Application Data

[62] Division of Ser. No. 202,981, Nov. 3, 1980, Pat. No. 4,390,059.

[51] Int. Cl.[3] ..... B23P 15/26

[52] U.S. Cl. ..... 29/157.3 R; 165/125; 165/76

[58] Field of Search ..... 165/125, 126, 76; 29/157.3 R

[56] References Cited

U.S. PATENT DOCUMENTS

| | | | |
|---|---|---|---|
| 2,620,720 | 12/1952 | Booth | 165/126 X |
| 4,380,263 | 4/1983 | Wright | 165/76 |
| 4,390,059 | 6/1983 | Haas et al. | 165/125 |
| 4,391,322 | 7/1983 | Ciarlei et al. | 165/125 |
| 4,392,525 | 7/1983 | O'Mara et al. | 165/125 |

*Primary Examiner*—Howard N. Goldberg
*Assistant Examiner*—V. K. Rising
*Attorney, Agent, or Firm*—Robert P. Hayter

[57] ABSTRACT

Method of assembly of a heat exchange unit wherein an annular orifice having a U-shaped cross section is assembled to a heat exchange assembly. The grille of the unit is supported on a support ledge of the fan orifice. An annular top cover having an L-shaped cross section may be engaged to the fan orifice to define a control area space therebetween. The top cover engages a top cover support ledge of the fan orifice and the grille engages a grille support ledge of the fan orifice to form a subassembly.

4 Claims, 6 Drawing Figures

METHOD OF ASSEMBLING A HEATING EXCHANGER

This application is a division, of application Ser. No. 202,981, filed Nov. 3, 1980, now U.S. Pat. No. 4,390,059.

BACKGROUND OF THE INVENTION

1. Field of the Invention

The present invention relates to heat exchange units. More specifically, the present invention relates to a subassembly incorporating a fan orifice, top cover and a grille as well as a method of assembly thereof.

2. Prior Art

Wound fin heat exchangers are well known in the refrigeration and air conditioning field. A wound fin heat exchanger consists of a tube having a fin material wrapped about the tube in heat exchange relation therewith to promote heat transfer between the fluid flowing through the tube and a separate fluid flowing over the tube. Utilization of this type of heat exchanger, wound fin, has been found to be both cost effective and to provide the appropriate heat transfer with a minimum of tube length. A type of wound fin heat exchanger includes slit fin tubing wherein a sheet of fin material is slit laterally and then rolled to a generally U-shaped arrangement such that the non-slit portion is wound against the tube and the slit portions extend outwardly therefrom. To make advantageous use of wound fin heat exchangers it is necessary that the heat exchanger be configured to optimize heat transfer. Once the appropriate configuration is ascertained the wound fin tubing should then be maintained in that configuration for the life of the heat exchanger. It has been found that the cylindrical configuration having the air drawn inwardly through the cylindrical heat exchanger is a preferred design.

It has additionally been ascertained that various support arrangements for securing wound fin heat exchangers may also be used to support the remaining assemblies of the heat exchange unit. More particularly, the incorporation of a fan orifice defining a void and a top cover for encasing the annular orifice such that a space is provided therebetween wherein electrical controls may be mounted has proved advantageous. Additionally, this assembly may be provided such that a grille is secured between the fan orifice and the top cover and a fan motor coacting with the fan orifice surface may be suspended from the grille.

The herein described apparatus not only serves to provide a fan orifice but also provides an enclosed area for securing electrical components and acts to integrate the heat exchanger assembly with the wrapper of the unit and to provide an aesthetically pleasing arrangement of components.

SUMMARY OF THE INVENTION

It is an object of the present invention to provide apparatus for use in a heat exchange unit.

It is a further object of the present invention to provide a combination of an annular fan orifice and a top cover to act as a subassembly in a heat exchange unit while serving to both secure electrical components and define air guide surfaces. It is another object of the present invention to provide an assembly capable of being integrated with a grille which supports a fan motor and fan.

It is another object of the present invention to provide an aesthetically pleasing top assembly for use with a heat exchange unit.

It is a still further object of the present invention to provide an assembly for use with a heat exchange unit having a top cover which may be secured to a wrapper.

It is a still further object of the present invention to provide a safe, economical, reliable and easy to install and manufacture subassembly for use in a heat exchange unit.

Other objects will be apparent from the description to follow and the appended claims.

The above objects are achieved according to a preferred embodiment of the invention by the combination of a fan orifice, grille and top cover. An annular fan orifice having a generally U-shaped cross section is arranged to be mounted to the tube supports of a heat exchanger. This fan orifice includes an interior facing surface which coacts with the fan to provide an orifice arrangement as well as a discharge surface to promote air flow through the unit. The fan orifice additionally includes a grille support ledge and a top cover support ledge adapted to support the grille and to cover respectively. A circular grille having a solid edge portion is provided for resting on the grille support ledge. An annular top cover having an L-shaped cross section is provided for resting on the top portion of the fan orifice and for encasing the area within the fan orifice to provide a controls area in the heat exchange unit. Various surfaces are defined by the specific elements to achieve the appropriate design configuration. Additionally, means for integrating the tubular support and wrapper of the heat exchange unit with the top unit assembly are provided.

DESCRIPTION OF THE PREFERRED EMBODIMENT

The embodiment as described herein is adapted for use in a heat exchange unit having a base pan and a wound fin heat exchanger supported by a tube support assembly. It is to be understood that this invention has applicability to heat exchange units that are other than cylindrical and to heat exchange units incorporating heat exchangers that are formed from plate fin coil or heat exchange surfaces other than wound fin tubing. It is additionally to be understood that various modifications in the specific surfaces as well as the appearance of the unit may be made while maintaining the basic concepts disclosed herein.

Figure 1:
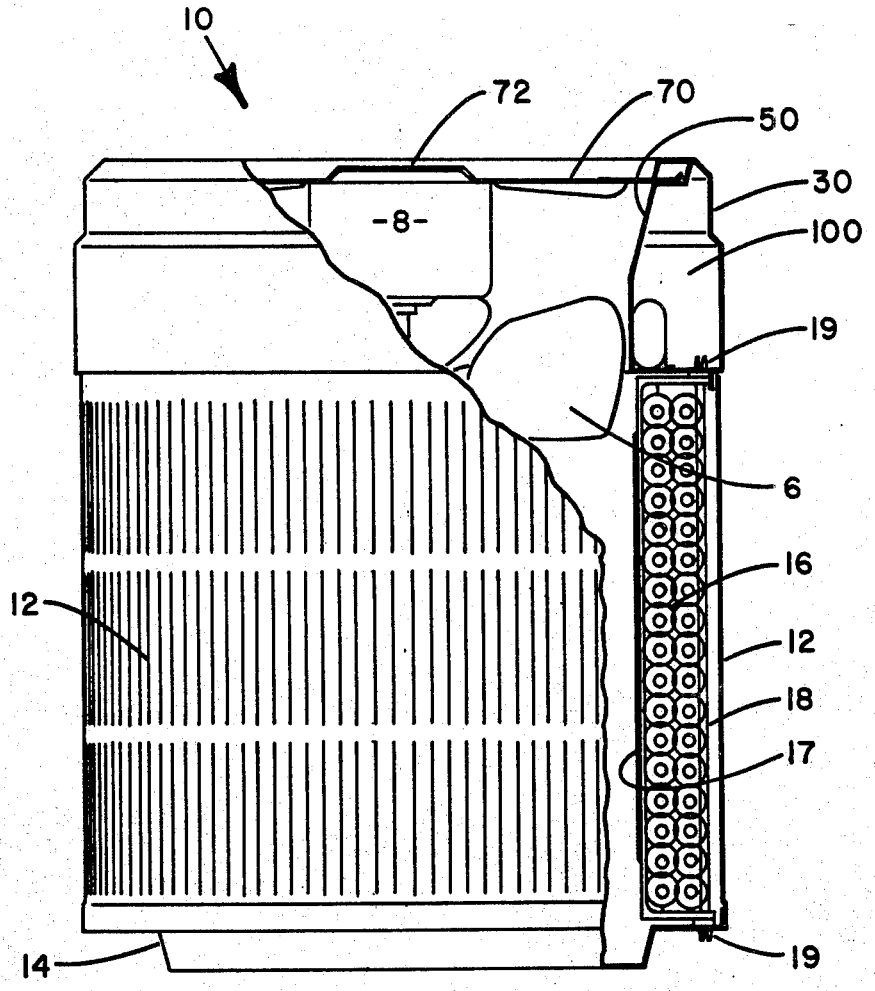
FIG. 1 is a partially cut away end view of a heat exchange unit incorporating the apparatus as set forth herein.

Referring to FIG. 1 there may be seen a cut away end view of heat exchange unit 10. The unit is shown having base pan 14 and wrapper 12 encasing heat exchanger 16.

A fan motor 8 having a fan 6 suspended therefrom is additionally disclosed. Heat exchanger 16 is shown as a series of wound fin tubes secured by tube retainer 17 and tubular support 18. The tubular support coacts with the tube retainer to maintain the various runs of wound fin tubing secured therebetween. Pins 19 are shown at each end of tube support 18 for securing the tubular support and the tube retainer to base pan 14 and fan orifice 50.

Fan orifice 50 is shown being annular in configuration and having grille 70 supported thereby. Additionally, top cover 30 is shown suspended on fan orifice 50. Top cover 30 and fan orifice 50 together define controls area 100. Grille cover 72 is additionally shown at the top center of grille 70.

Figure 3:
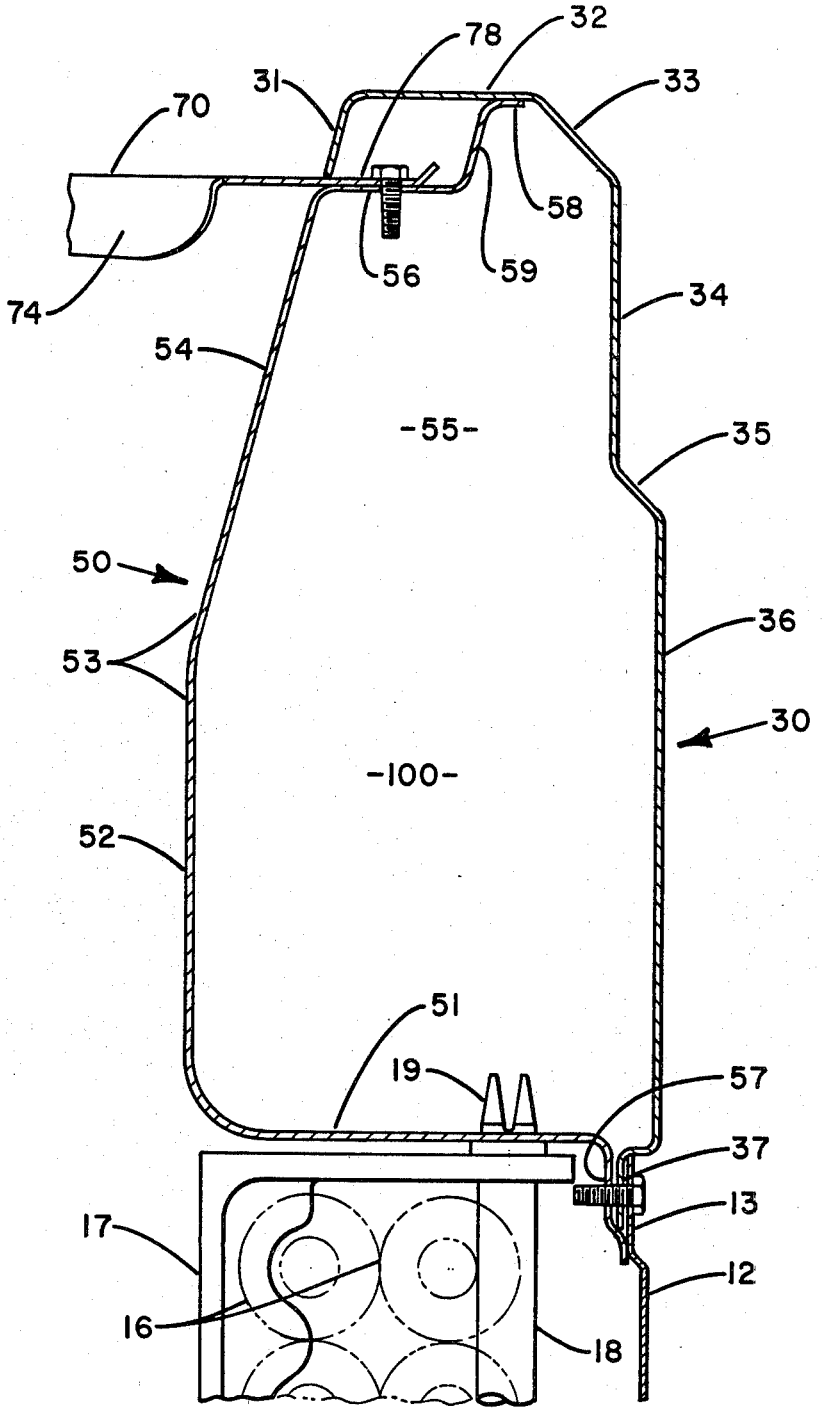
FIG. 3 is a partial sectional view of the top cover, fan orifice and grille of the unit as mounted to the heat exchanger support and wrapper.

FIG. 3 shows an enlarged view of the area of FIG. 1 incorporating the fan orifice and top cover. It can be seen more specifically therein that fan orifice 50 is generally U-shaped in cross section and has a series of surfaces. Starting from the top and continuing toward the bottom the fan orifice includes top cover support ledge 58, connecting portion 59, grille support ledge 56, discharge surface 54, orifice surface 52, bottom portion 51 and sealing lip 57. Orifice surface 52 and discharge surface 54 are both collectively referred to as air flow surfaces 53.

Top cover 30 is shown having securing flange 31 connected to top portion 32 connected respectively to first inclined surface 33, first vertical surface 34, second inclined surface 35, second vertical surface 36 and indented closure lip 37. Grille 70 is shown having edge portion 78 mounted on grille support ledge 56. Louver segment 74 of the grille portion is additionally shown. It can be seen that top portion 32 of the top cover rests on top cover support ledge 58 of the fan orifice and that securing flange 31 extending from the top portion extends downwardly generally parallel and coplanar with discharge surface 54 to promote air flow through the grille and acts to cover the grille support edge 78 and the fastening means therefor such that in a visual inspection of the unit the outwardly terminating edge of the grille is not visible.

Tube retainer 17 and tubular support 18 are shown securing heat exchanger 16 therebetween. Pin 19 extends into tubular support 18 engaging same and acts to secure the tubular support and the tube retainer relative to the fan orifice. Sealing lip 57 of fan orifice 50 and indented closure lip 37 of top cover 30 are shown secured to the wrapper mating portion 13 with a screw. Wrapper 12 extends over a portion of the exterior unit outside the heat exchanger and is secued to the top cover and fan orifice at the wrapper mating portion.

Figure 2:
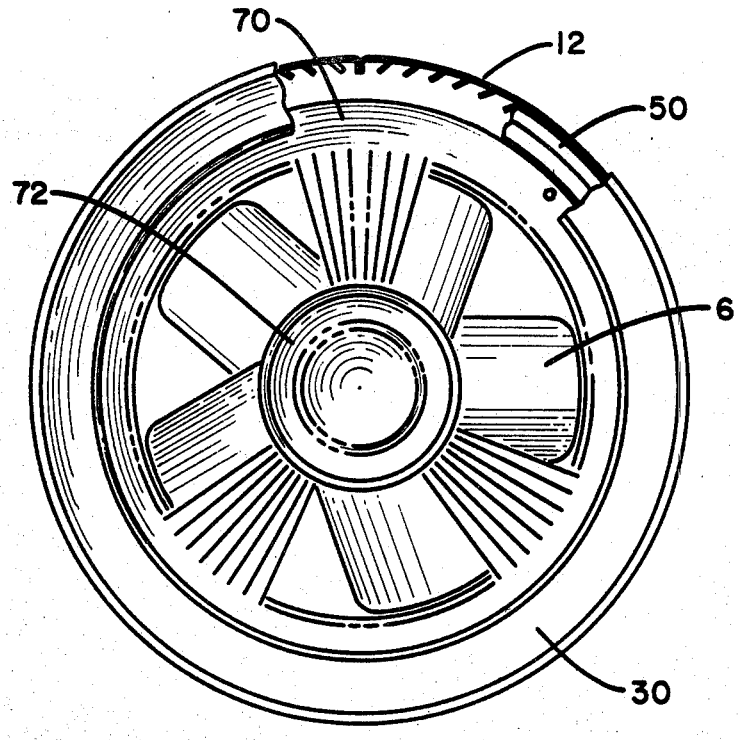
FIG. 2 is a partially cut away top view of a heat exchange unit.

FIG. 2 shows a top view of a heat exchange unit with fan 6 suspended from the grille. Grille 70 is shown with grille cover 72 attached thereto. The relationship between the grille and fan orifice 50 together with top cover 30 and wrapper 12 may be seen therein.

Figure 4:
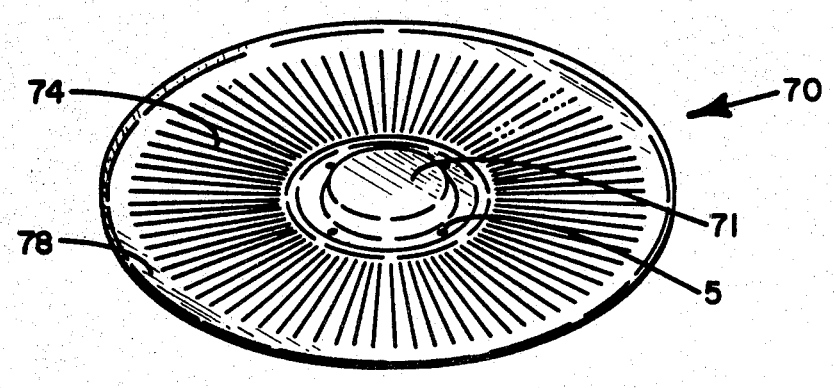
FIG. 4 is a perspective view of the grille of the heat exchange unit.
Figure 5:
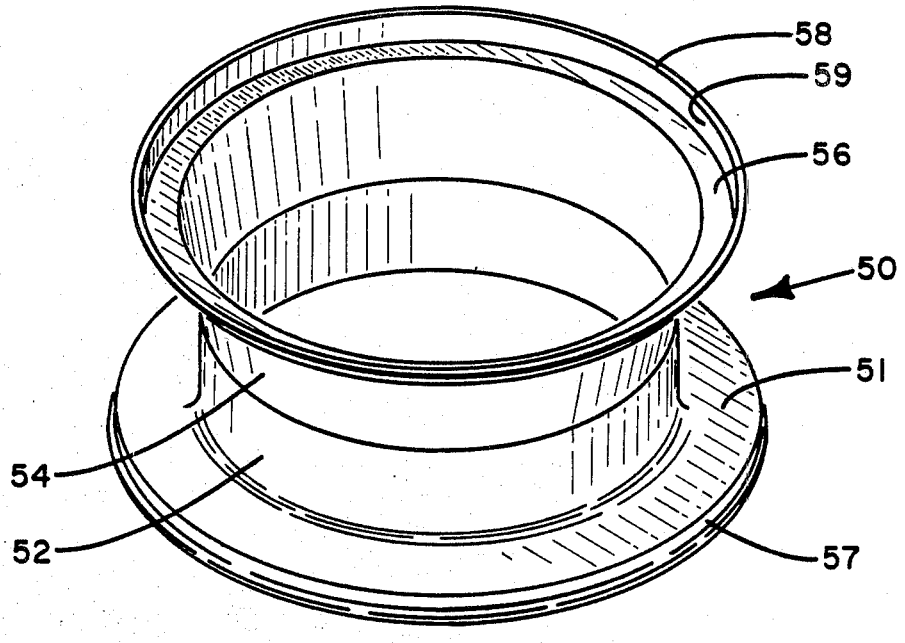
FIG. 5 is a perspective view of the fan orifice of the heat exchange unit.
Figure 6:
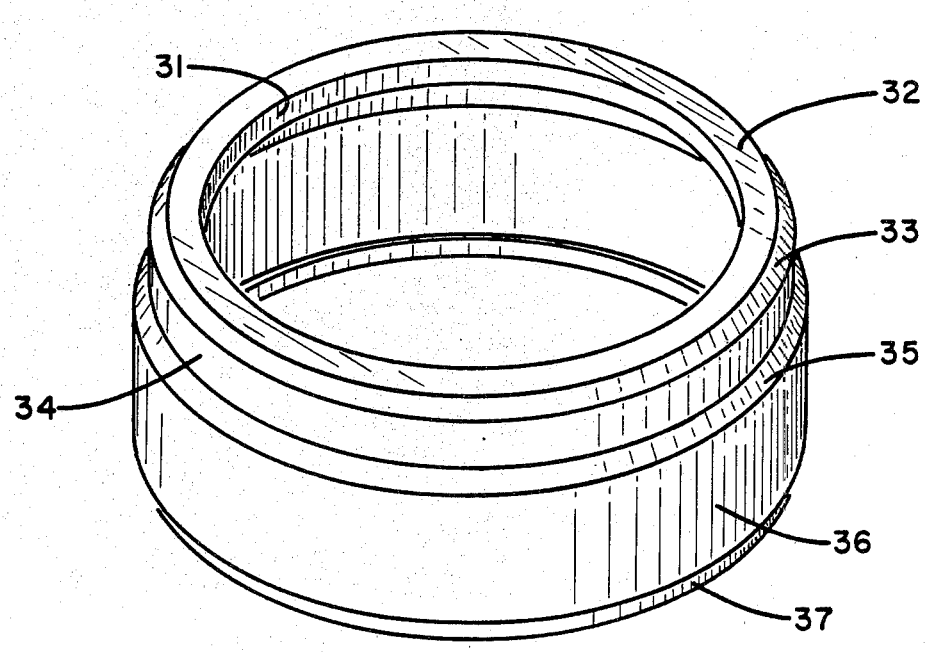
FIG. 6 is a perspective view of the top cover of the heat exchange unit.

FIGS. 4, 5 and 6 are isometric views of the three principle components of the assembly. FIG. 4 shows the grille having louvers 74, center portion 71, fan motor bolts 5 and edge portion 78. Fan orifice 50 as shown in FIG. 5 has various components including top cover support ledge 58, connecting portion 59, grille support ledge 56, discharge surface 54, orifice surface 52, bottom portion 51 and sealing lip 57. Similarly, in FIG. 6 the top cover may be seen having a securing flange 31, top portion 32, first inclined surface 33, first vertical surface 34, second inclined surface 35, second verticl surface 36 and indented closure lip 37.

Upon manufacture of the unit, the various parts are individually formed. The top cover and fan orifice are formed with hydraulic expansion type means to the desired configuration. The unit is assembled by securing the heat exchanger assembly to the base pan. Thereafter, the fan orifice is placed on top of the heat exchange assembly and secured thereto with pin 19. The various electrical components may be secured within the fan orifice at some point in time. The grille, already having the fan motor and fan suspended therefrom, is then placed on the assembly such that the edge portion 78 of the grille engages grille support ledge 56 of the fan orifice to secure same. The top cover of the unit is then slid downwardly over the partially assembled components until top portion 32 engages the top cover support ledge 58 to secure same. Securing flange 31 extending from the top cover abuts grille 70 to engage the end of grille portion 78. When assembled, the top cover coacts with the fan orifice to define controls area 100, a completely metal encased area for complying with various electrical requirements. Sealing lip 57 of the fan orifice and indented closure lip 37 of the top cover align together with wrapper 12 such that all may be secured with a single screw. The wrapper may be placed around the unit after the top cover has been assembled to the other components or earlier. Among the advantages of this construction the serviceman may remove the top cover and have access to the electrical components while the unit is operating. The fan may be operated while the top cover is off without danger to the serviceman. Additionally, the grille and attached fan may be removed to allow the serviceman access to the remainder of the unit. The construction further provides a unit which is strong enough to be stacked for shipping and has no protruding parts to cause packaging or handling problems.

The herein invention has been described with reference to a particular embodiment. It is to be understood that variations and modifications can be effected within the spirit and scope of this invention.

What is claimed is:

1. A method of manufacturing a heat exchange unit having a heat exchanger assembly supported by a base pan which comprises:

forming an annular fan orifice having a U-shaped cross section including a grille support portion and a top cover support portion;

securing the fan orifice to the heat exchanger assembly;

mounting a grille assembly such that it is supported by the grille support portion of the fan orifice;

forming an annular top cover having a generally L-shaped cross section and including a top portion; and sliding the top cover over the fan orifice such that the top portion of the top cover engages the top cover support portion of the fan orifice and such that a void is defined between the top cover and the fan orifice.

2. The method as set forth in claim 1 and further comprising the step of connecting a fan motor and fan to the grille assembly such that after the step of mounting the fan is positioned appropriately with the fan orifice.

3. The method as set forth in claim 1 and further comprising the step of affixing a wrapper about the heat exchanger and to both the top cover and fan orifice to hold the fan orifice, top cover and wrapper in a predetermined position.

4. The method as set forth in claim 1 and further comprising the step of placing electrical components of the heat exchange unit in the void defined between the top cover and the fan orifice.

* * * * *